US006105377A

United States Patent [19]

Jeong et al.

[11] Patent Number: 6,105,377

[45] Date of Patent: Aug. 22, 2000

[54] AIR CURTAIN FAN DRIVING DEVICE AND METHOD FOR A REFRIGERATOR

[75] Inventors: Jae-Youk Jeong; Byung-Joon Choi, both of Incheon, Rep. of Korea

[73] Assignee: Daewoo Electronics Co., Ltd., Seoul, Rep. of Korea

[21] Appl. No.: 09/216,939

[22] Filed: Dec. 21, 1998

[30] Foreign Application Priority Data

Oct. 30, 1998 [KR] Rep. of Korea ..... 98-20885
Oct. 30, 1998 [KR] Rep. of Korea ..... 98-46140

[51] Int. Cl.[7] ..... F25D 17/00

[52] U.S. Cl. ..... 62/180; 62/256; 62/408

[58] Field of Search ..... 62/131, 186, 256, 62/408, 180

[56] References Cited

U.S. PATENT DOCUMENTS 4,299,092 11/1981 Ibrahim ..... 62/81
4,379,391 4/1983 Rhee ..... 62/408
5,263,332 11/1993 Park ..... 62/157
5,269,152 12/1993 Park .
5,678,416 10/1997 Yoo .
5,784,895 8/1998 Choi ..... 62/407
5,791,152 8/1998 Choi .
5,809,799 9/1998 Jeon ..... 62/408
5,870,898 2/1999 Choi ..... 62/89
5,875,642 3/1999 Lee et al. ..... 62/256
5,896,752 4/1999 Park ..... 62/186

FOREIGN PATENT DOCUMENTS

10/205 965 8/1998 Japan .

*Primary Examiner*—Henry Bennett
*Assistant Examiner*—Marc Norman
*Attorney, Agent, or Firm*—Smith, Gambrell & Russell, LLP

[57] ABSTRACT

A temperature setting part sets a reference temperature of the interior of a refrigerating compartment of a refrigerator. A door opening/closing detection part detects opening and closing of a door of the refrigerating compartment. First and second temperature detecting parts detect the interior and exterior temperatures of the refrigerating compartment respectively. An air curtain fan driving part drives an air curtain fan. A control part performs a normal cooling operation to control the interior temperature of the refrigerating compartment by driving the cooling fan when the interior temperature is under a reference temperature, drives the air curtain fan with each of the numbers of rotations corresponding to each of several temperature ranges, and performs the normal cooling operation by stopping the driving of the air curtain fan if the closing of the door of the refrigerating compartment is detected. Cooling efficiency and electric power efficiency are enhanced by efficiently driving the air curtain fan according to the interior and exterior conditions of the refrigerating compartment.

7 Claims, 5 Drawing Sheets

AIR CURTAIN FAN DRIVING DEVICE AND METHOD FOR A REFRIGERATOR

BACKGROUND OF THE INVENTION

1. Field of the Invention

The present invention relates to a refrigerator, and more particularly to an air curtain fan driving device and method for a refrigerator for driving an air curtain fan according to interior and exterior conditions of a refrigerator.

2. Description of the Prior Art

Viewing the refrigerant circulation cycle in a refrigerator, as gas refrigerant with high-temperature and high-pressure caused by a compressor passes through a condenser, the gas refrigerant transmits its heat to the exterior and is converted into liquid refrigerant. Thereafter, the liquid refrigerant, which still has high pressure, passes through a dryer, so that foreign materials and water component in the liquid refrigerant are removed, and the liquid refrigerant without the foreign materials and water moves to the capillary tube. The liquid refrigerant moving through the capillary tube expands in a liquid/gas-mixed state to easily evaporate, thereby absorbing ambient heat in order for the refrigerant to return to the original refrigerant condition. Accordingly, the refrigerant is repeatedly circulated as a cooling air supply in the refrigerator.

During operation of the refrigerator, the interior temperature of the refrigerator may rise due to an overload in the refrigerating compartment of the refrigerator and if exterior air flows in the refrigerating compartment while the refrigerating compartment door is opened. At this time, in order to return the interior temperature of the refrigerating compartment to a normal state, an air curtain fan has been mounted in the refrigerating compartment in recent years.

A temperature control method for refrigerator is disclosed, in U.S. Pat. No. 5,263,332 granted to Mr. Park on Nov. 23, 1993, for reducing the cooling time by stabilizing the temperature fluctuation occurring when the refrigerator door is opened. The patent includes a step for controlling a compressor and a fan for a normal operation in order to maintain interior temperature of a refrigerator at a temperature preset by a user (called "normal operation step"). In a door-opening control step, if opening of a door of the refrigerator is detected, the fan is turned off, and a time period during the opening of a door of the refrigerator is calculated until closing of the door is detected. Thereafter, if the closing of the door is detected, a temperature-resetting step restarts the normal operation step after automatically resetting the preset temperature based on the calculated time period. A reset temperature operation step determines whether the temperature is reset during the normal operation step. If the temperature is reset, the compressor and the fan are driven for a cooling operation until the temperature reaches reset temperature. Thereafter, the reset temperature operation step restarts the normal operation step. The patent of Mr. Park enhances food preservation and the efficiency of the refrigerator since the interior temperature influenced by exterior air when a door of the refrigerator has been opened is rapidly stabilized after the closing of the door.

Hereinafter, a conventional air curtain fan driving device will be described in detail with reference to FIG. 1. FIG. 1 is a view for showing a conventional air curtain fan driving device. The conventional air curtain fan driving device 10 includes an air curtain fan 100, a temperature detector 102, a compressor 104, a compressor driver 106, a cooling fan 108, a cooling fan driver 110, an air curtain fan driver 112, and a controller 114.

The temperature detector 102 detects an interior temperature T1 of the refrigerator under the control of the controller 114. The detection of the interior temperature T1 of the refrigerator is applied to the controller 114. The compressor 104 converts normal gas refrigerant into gas refrigerant of high temperature and high pressure. The compressor driver 106 controls the driving of the compressor 104. The cooling fan 108 blows cool air into the refrigerating compartment. The cooling air is provided from the evaporator (not shown). The cooling fan driver 110 controls the driving of the cooling fan 108. The controller 114 controls the operations of the temperature 102, compressor driver 106, cooling fan driver 110, and air curtain fan driver 112. The controller 114 causes normal cooling operations to be performed since the controller 114 drives the compressor 104 and cooling fan 108 by the compressor driver 106 and cooling fan driver 110 respectively. The controller 114 determines whether the interior temperature T1 of the refrigerating compartment detected by the temperature detector 102 is normal.

Hereinafter, operations of the conventional air curtain fan driving device will be described in detail.

FIG. 2 is a flow chart for explaining operations of the conventional air curtain fan driving device of FIG. 1.

When electric power is applied, the controller 114 drives the compressor 104 and cooling fan 108 by means of the compressor driver 106 and cooling fan driver 110 respectively, so that normal cooling operations are performed (step S201). The temperature detector 102 detects an interior temperature T1 of the refrigerator under the control of the controller 114 (step S202). The detected interior temperature T1 is transmitted to the controller 114. The controller 114 determines whether the detected interior temperature T1 is a normal temperature by the temperature detector 102 (step S203). If the detected interior temperature T1 is below or over the normal temperature as a result of the determination of the step S203, the compressor driver 106 drives the compressor 104 under the control of the controller 114 (step S204). Thereafter, the cooling fan driver 108 and the air curtain fan driver 112 drive the cooling fan 108 and the air curtain fan 100 under the control of the controller 114 respectively (step S205). In step 206, the controller 114 determines again whether the detected interior temperature T1 by the temperature detector 102 is the normal temperature. If the detected interior temperature T1 is below or over the normal temperature as a result of the determination of the step S206, the step S204 is restarted.

In the meantime, if the detected interior temperature T1 is determined as the normal temperature, the controller 114 enables the normal cooling operations to be performed (S207).

With the conventional method as mentioned above, if the temperature of the refrigerating compartment is below the normal temperature, the cooling efficiency is enhanced by driving the air curtain fan as well as the cooling fan. However, by means of the conventional method, if the refrigerator door is opened, the air curtain fan is driven regardless of the interior or exterior temperature of the refrigerating compartment. Accordingly, the air curtain fan prevents the cool air from flowing out when the refrigerator door is open, but electric power is excessively consumed.

SUMMARY OF THE INVENTION

It is an object of the present invention to provide an air curtain fan driving device for a refrigerator capable of efficiently controlling the driving of the air curtain fan in accordance with interior and exterior conditions of the refrigerating compartment of a refrigerator.

It is another object of the present invention to provide an air curtain fan driving method for a refrigerator capable of efficiently controlling the driving of the air curtain fan in accordance with interior and exterior conditions of the refrigerating compartment of a refrigerator.

In order to achieve the above objects, an air curtain fan driving device according to the present invention includes a temperature setting part, a door opening/closing detection part, first and second temperature detecting parts, an air curtain fan driving part, and a control part. The temperature setting part sets a reference temperature of an interior of a refrigerating compartment of a refrigerator. The door opening/closing detection part detects the opening and closing of a door of the refrigerating compartment. The first and second temperature detecting parts detect the interior and exterior temperatures of the refrigerating compartment respectively. The air curtain fan driving part is for driving an air curtain fan. The control part performs a normal cooling operation to control the interior temperature of the refrigerating compartment by driving the cooling fan when the interior temperature is under a reference temperature, drives the air curtain fan with each of the numbers of rotations corresponding to each of several temperature ranges, and performs the normal cooling operation by stopping the driving of the air curtain fan if the closing of the door of the refrigerating compartment is detected. The temperature difference indicates the exterior temperature. The temperature difference is the difference between the interior temperature and the exterior temperature. The control part of the air curtain fan driving device for the refrigerating compartment sets a weighted value if the cooling fan is driven, and enables the air curtain fan to be driven with a number of rotations added by the weighted value to the number of rotations of the air curtain fan if the door of the refrigerating compartment is opened during the driving of the cooling fan.

In order to achieve the air curtain fan driving method, the method comprises steps of a) performing a normal refrigerating operation for controlling an interior temperature of a refrigerating compartment by setting a reference temperature of a refrigerating compartment of a refrigerator and by driving a cooling fan under the reference temperature, b) driving the air curtain fan with the number of rotations of the air curtain fan set according to several temperature ranges, wherein the several temperature ranges result from the temperature difference calculated based on the exterior temperature and the interior temperature if the opening of the door of the refrigerating compartment of the refrigerator is detected, and c) performing the normal refrigerating operation by stopping the air curtain fan if the closing of the refrigerating compartment of the refrigerator is detected. In the steps, the temperature difference is the exterior temperature. The temperature difference is the difference between the exterior temperature and the interior temperature of the refrigerating compartment of the refrigerator. Further, in an air curtain fan driving method may comprise steps of a) performing a normal refrigerating operation for controlling an interior temperature of a refrigerating compartment by setting a reference temperature of a refrigerating compartment of a refrigerator and by driving a cooling fan under the reference temperature, b) driving the air curtain fan with the number of rotations of the air curtain fan set according to several temperature ranges, wherein the several temperature ranges result from the temperature difference calculated based on the exterior temperature and the interior temperature if the opening of the door of the refrigerating compartment of the refrigerator is detected, 3) performing the normal refrigerating operation by stopping the air curtain fan if the closing of the refrigerating compartment of the refrigerator is detected. Here, the temperature difference is the exterior temperature. The temperature difference is the difference between the exterior temperature and the interior temperature of the refrigerating compartment.

BRIEF DESCRIPTION OF THE DRAWINGS

These and other objects and features of the present invention can be understood through the following embodiment by reference to the accompanying drawing, in which.

DETAILED DESCRIPTION OF THE PREFERRED EMBODIMENTS

Hereinafter, the air curtain fan driving device according to the first and second embodiments of the present invention will be described in detail with reference to the accompanying drawings.

The First Embodiment

Figure 1:
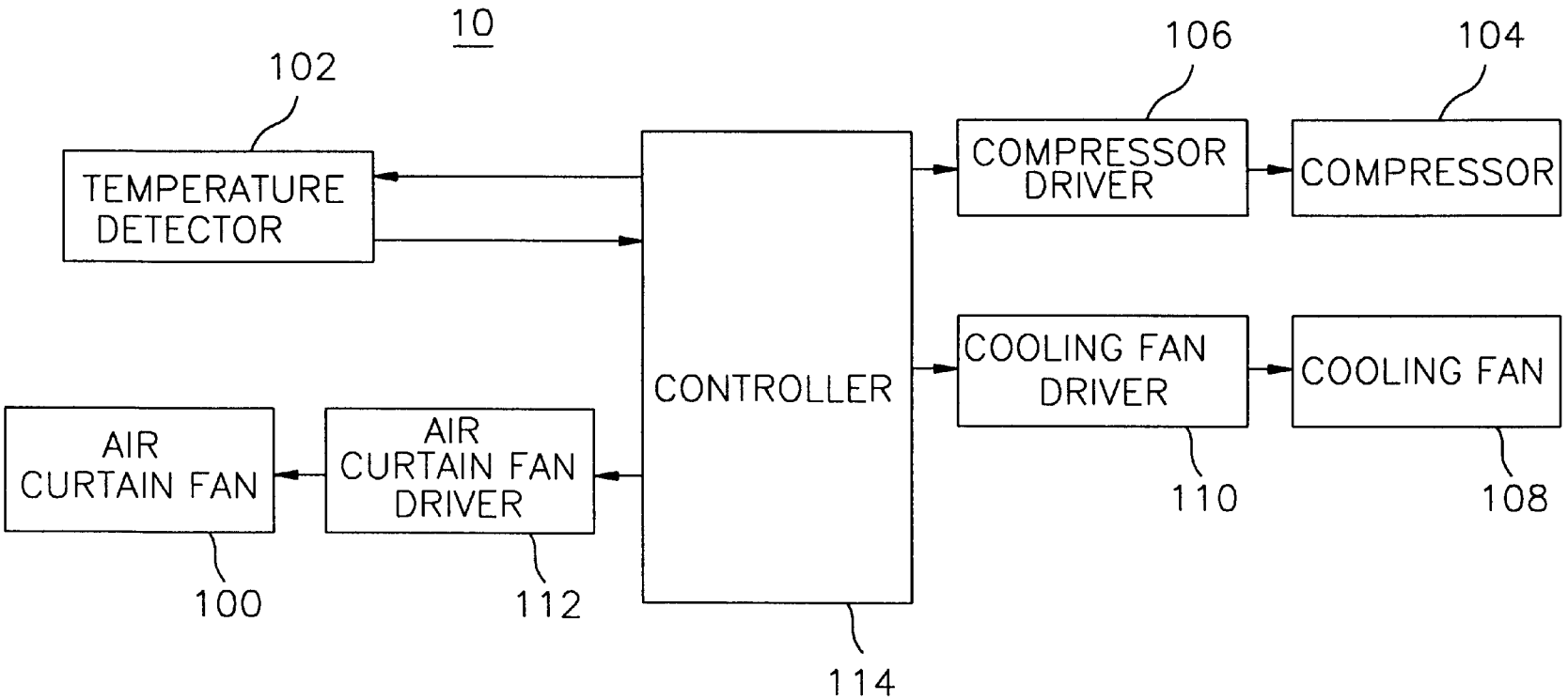
FIG. 1 is a view for showing a conventional air curtain fan driving device for a refrigerator.
Figure 2:
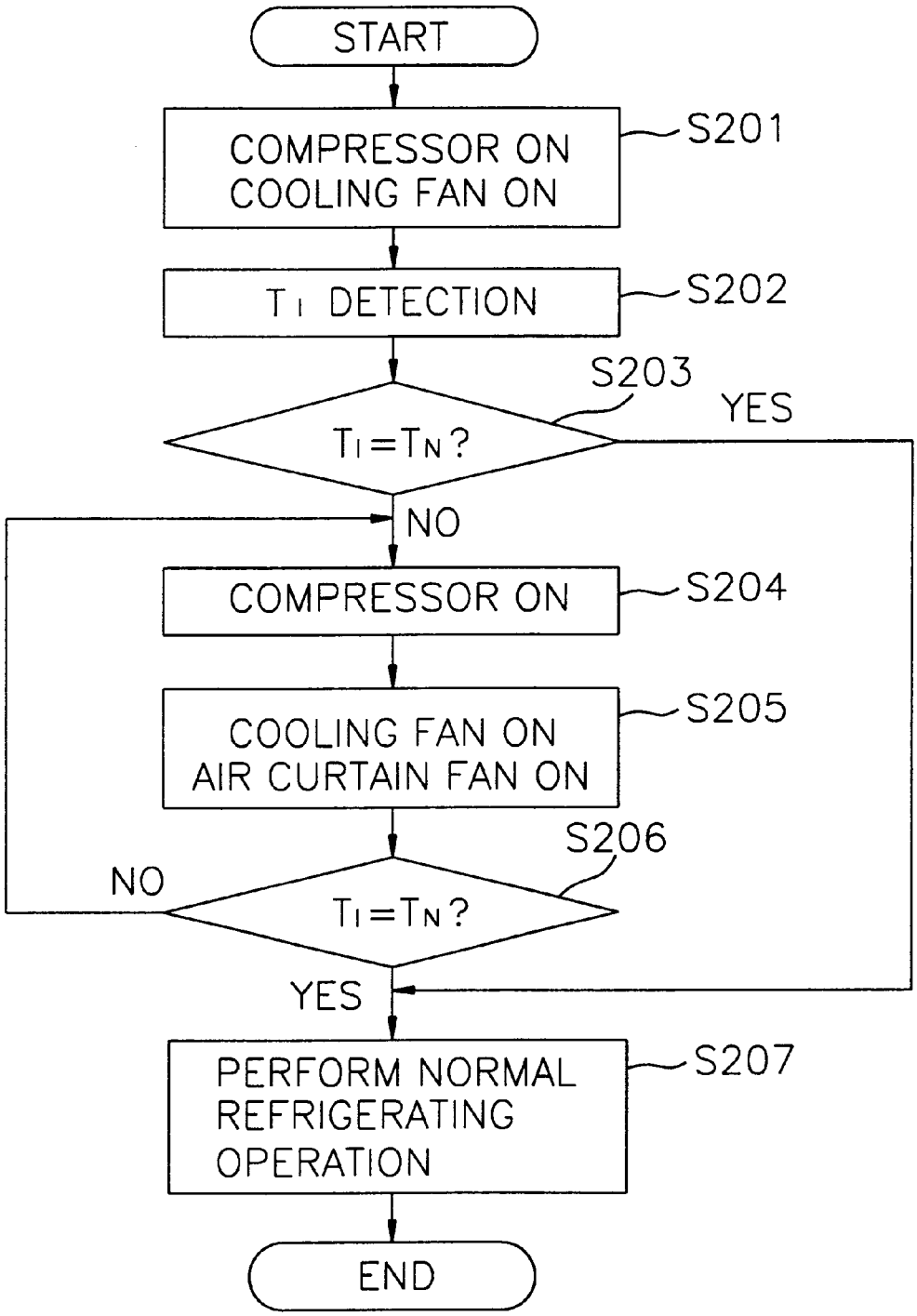
FIG. 2 is a flow chart for explaining operations of the conventional air curtain fan driving device of FIG. 1.
Figure 3:
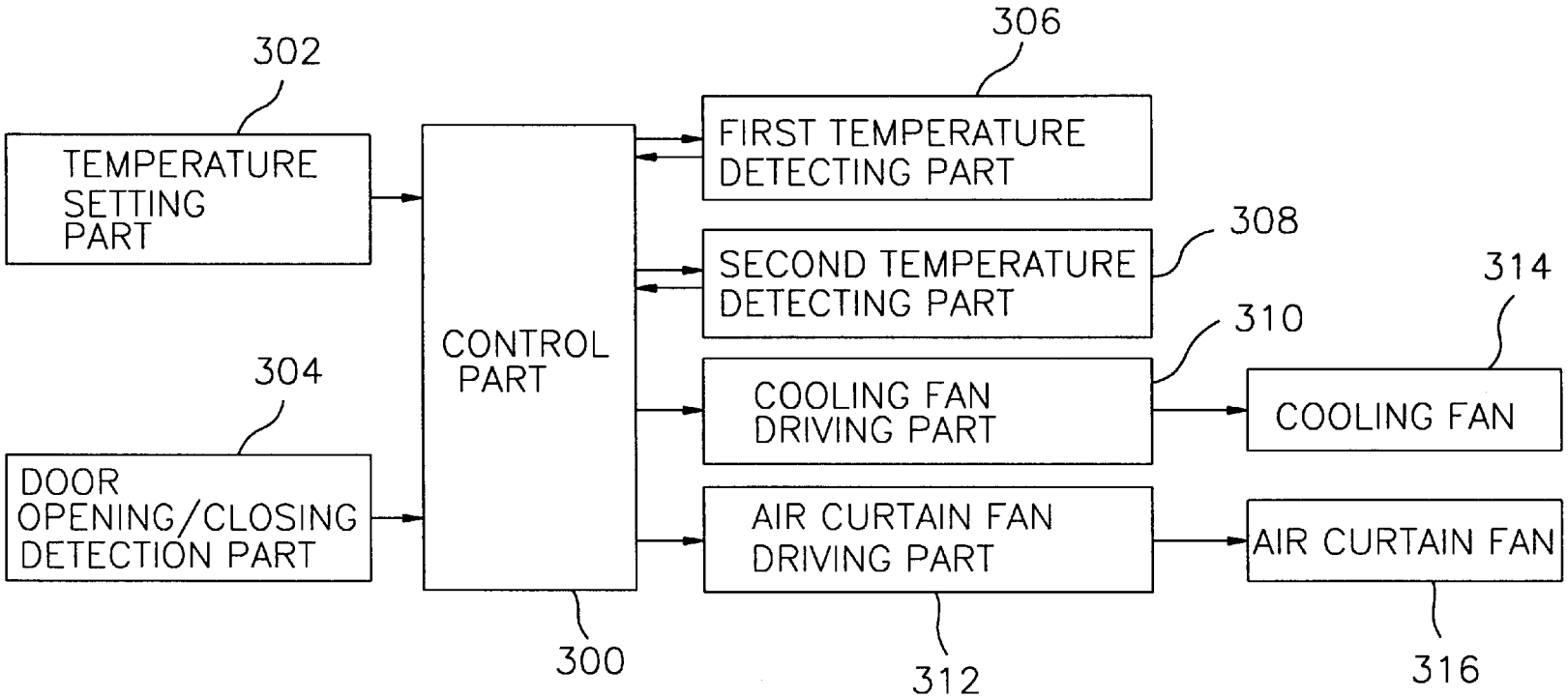
FIG. 3 is a block diagram for showing an air curtain fan driving device for a refrigerator according to the first and second embodiments of the present invention.

The air curtain fan driving device for a refrigerator 30 according to the first embodiment of the present invention is shown in FIG. 3.

The device 30 includes a temperature setting part 302, a door opening/closing detection part 304, a first temperature detecting part 306, a second temperature detecting part 308, a cooling fan driving part 310, an air curtain fan driving part 312, a cooling fan 314, an air curtain fan 316, and a control part 300.

The temperature setting part 302 enables a user to set a reference temperature Tr for controlling the interior temperature T1 of the refrigerating compartment. The door opening/closing detection part 304 detects whether the refrigerator door is opened or closed by means of a switching circuit. The first temperature detecting part 306 measures the interior temperature T1 of the refrigerating compartment. The second temperature detecting part 308 measures exterior temperature T0 around the refrigerating compartment. The measured interior and exterior temperatures T1 and T0 are applied to the control part 300. The cooling fan driving part 310 controls the driving of the cooling fan 314. The air curtain fan driving part 310 controls the driving of the air curtain fan 300. The control part 300 performs normal cooling operations for maintaining the temperature of the refrigerating compartment at the reference temperature Tr by operating the cooling fan 314 in case that the interior temperature T1 of the refrigerating compartment is higher than the reference temperature Tr of the refrigerating compartment. The control part 300 sets a weighted value M to "0" when the cooling fan is disenabled during the normal cooling operation. Further, the control part 300 sets the weighted value M to "M0" when the cooling fan is enabled. The control part 300 determines whether the cooling fan 314 is driven in case that the opening of the door of the refrigerating compartment is detected from the door opening/closing detection part 304 during the normal cooling operations. The exterior temperature T0 of the refrigerating compartment measured by means of the second temperature detecting part 308 is classified into several temperature ranges. If the cooling fan 314 is disenabled at the time the door of the refrigerating compartment is opened, the air curtain fan 316 is enabled to be operated at a higher speed in a higher temperature range. For example, the exterior temperature T0 is classified into several temperature ranges such as T1(T0<20° C.), T2(20° C.≦T0≧30° C.), and T3(30° C.≦T0). The air curtain fan is driven in several rotation numbers, which will be denoted as reference numerals RPM1, RPM2, and RPM3, according to the temperature ranges, so that the air curtain fan is driven at a higher rotation number in a higher temperature range. The number of rotations of the air curtain fan at the normal temperature is denoted as a reference numeral RPM. If the door of the refrigerating compartment is opened, a weighted value M, which is determined for each of the temperature ranges, is added to each of the numbers of rotations. That is, if the cooling fan 314 is driven, the air curtain fan 316 is driven with the number of rotations added by Mo to each of the numbers of rotations RPM1, RPM2, and RPM3 corresponding to each of the temperature ranges. For example, the air curtain fan 316 is driven at the number of rotations of RPM1', or RPM2', or RPM3' at the exterior temperature classified into T1(T0<20° C.), or T2(20° C.≦T0≦30° C.), or T3(30° C.≦T0), wherein RPM1'=RPM1+Mo, RPM2'=RPM2+Mo, and RPM3'=RPM3+Mo.

Figure 4:
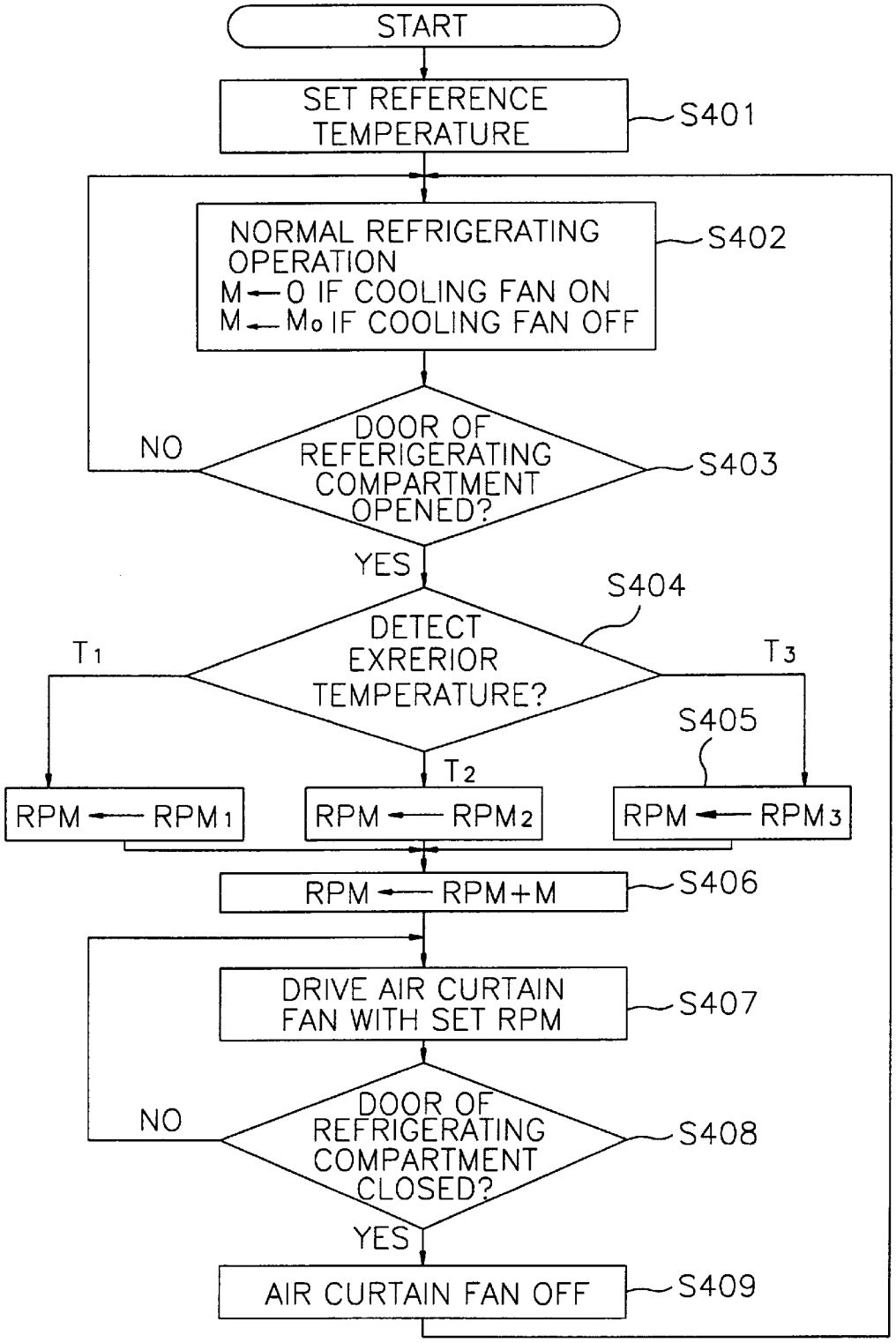
FIG. 4 is a flow chart for explaining operations of the air curtain fan driving device for a refrigerator according to the first embodiment of the present invention.

Hereinafter, the air curtain fan driving method according to the first embodiment of the present invention will be described in detail with reference to FIG. 4. FIG. 4 is a flow chart for explaining the air curtain fan driving method for a refrigerator according to the first embodiment of the present invention.

If a user sets a reference temperature Tr for controlling an interior temperature T1 of the refrigerating compartment with a manipulation of the temperature setting part 302, the set reference temperature Tr is inputted into the control part 312 (step S401). In general, since the interior temperature T1 of the refrigerating compartment is in a range of 0° C. to 5° C., the reference temperature Tr is set from 0° C. to 5° C.

In step S402, the control part 300 enables the cooling fan 314 to be driven in case that the interior temperature T1 of the refrigerating compartment is higher than the reference temperature Tr of the refrigerating compartment, so that the normal cooling operation is performed to maintain the temperature of the refrigerating compartment at the reference temperature Tr.

While performing the normal cooling operation, the control part 300 sets the weighted value M at "0" in case that the cooling fan is disenabled, and sets the weighted value M at Mo in case that the cooling fan is enabled.

In step S403, the control part 300 detects whether the door of the refrigerating compartment is opened or closed from the door opening/closing detection part 304 during the normal cooling operation. In case that the door of the refrigerator is closed, the refrigerator returns to the normal cooling operation (step S402). If the door of the refrigerator is opened, in step S404 the control part 300 classifies the exterior temperature T0 into the temperature ranges, and the exterior temperature is measured by means of the second temperature detecting part 308. For example, the exterior temperature T0 is classified into T1(T0<20° C.), T2(20° C.≦T0<30° C.), and T3(30° C.≦T0).

In step S405, the control part 300 sets the number of rotations RPM corresponding to each of the temperature range (step S405: RPM←RPM1 when the reference temperature T0 is included in the temperature T1, RPM←RPM2 when the reference temperature T0 is included in the temperature T2, and RPM←RPM3 when the reference temperature T0 is included in the temperature T3). From Table 1, the number of rotations RPM1 is preset at 1500, RPM2 is preset at 1700, and RPM3 is preset at 1900.

In step S406, the number of rotations RPM of the air curtain fan is set by adding M to the number of rotations of the preset air curtain fan (RPM←RPM+M). That is, if the cooling fan 314 is disenabled when the door of the refrigerating compartment is opened, the air curtain fan is driven with the number of rotations added by Mo to the preset number of rotations of the air curtain fan since M=Mo (RPM←RPM+0). In the meantime, if the cooling fan is driven when the door of the refrigerating compartment is opened, the air curtain fan is driven with the number of rotations added by Mo to the number of rotations of the air curtain fan since M=Mo(RPM←RPM+Mo). From Table 1, the weighted value Mo is set at 300.

In step S407, the air curtain fan 316 is driven with the number of rotations RPM which has been set.

TABLE 1

| | environment | | | | | |
|---|---|---|---|---|---|---|
| | COOLING FAN OFF | | | COOLING FAN ON | | |
| air | T1 | T2 | T3 | T1 | T2 | T3 |
| air curtain fan | 1500 | 1700 | 1900 | 1800 | 2000 | 2200 |

Ex) exterior temperature ranges: T1/T2/T3

T1: T0<20° C., T2: 20° C.≦T0<30° C., T3: 30° C.≦T0

Step S408 detects is performed whether the door of the refrigerating compartment is closed. If the door of the refrigerating compartment is opened, the air curtain fan 316 continues to be driven (step S408), and if the door of the refrigerating compartment is closed, the air curtain fan 316 is opened (step S409), so that the air curtain fan starts the normal cooling operation (step S402).

As stated above, according to the embodiment, the exterior temperature is classified into several temperature ranges. The higher the exterior temperature becomes, the higher the number of rotations of the air curtain fan occurs. Further, if the door of the refrigerating compartment is opened while the cooling fan is driven, the cooling fan automatically stops. In order to compensate for this, the air curtain fan is adapted to be driven with the number of rotations added by a weighted value to the number of rotations of the air curtain fan. Therefore, the air curtain fan is efficiently driven according to the interior and exterior conditions of the compartment, so that the cooling efficiency and electric power efficiency are enhanced.

The Second Embodiment

FIG. 3 is a block diagram for showing an air curtain fan driving device 30 for a refrigerator according to the second embodiment of the present invention. The second embodiment has the same structure as the first embodiment has. However, the first embodiment classifies into several temperature ranges the exterior temperature T0 of the refrigerating compartment measured by the second temperature detecting part 308, while the second embodiment classifies into several temperature ranges the temperature difference (T0−T1) between the exterior temperature T0 and the interior temperature T1, wherein the exterior temperature T0 of the refrigerating compartment is measured by the second temperature detecting part 308, and the interior temperature T1 of the refrigerating compartment is measured by the first temperature detecting part 306. For example, the temperature difference (T0−T1) is classified into T4(T0−T1<15° C.), T5(15° C.≦T0−T1≦25° C.), and T6(25° C.≦T0−T1). In order for the air curtain fan to be driven with a higher number of rotations in a higher temperature range, the number of rotations RPM of the air curtain fan is set at the numbers of ratation RPM4, RPM5, and RPM6, respectively, corresponding to temperature ranges.

Figure 5:
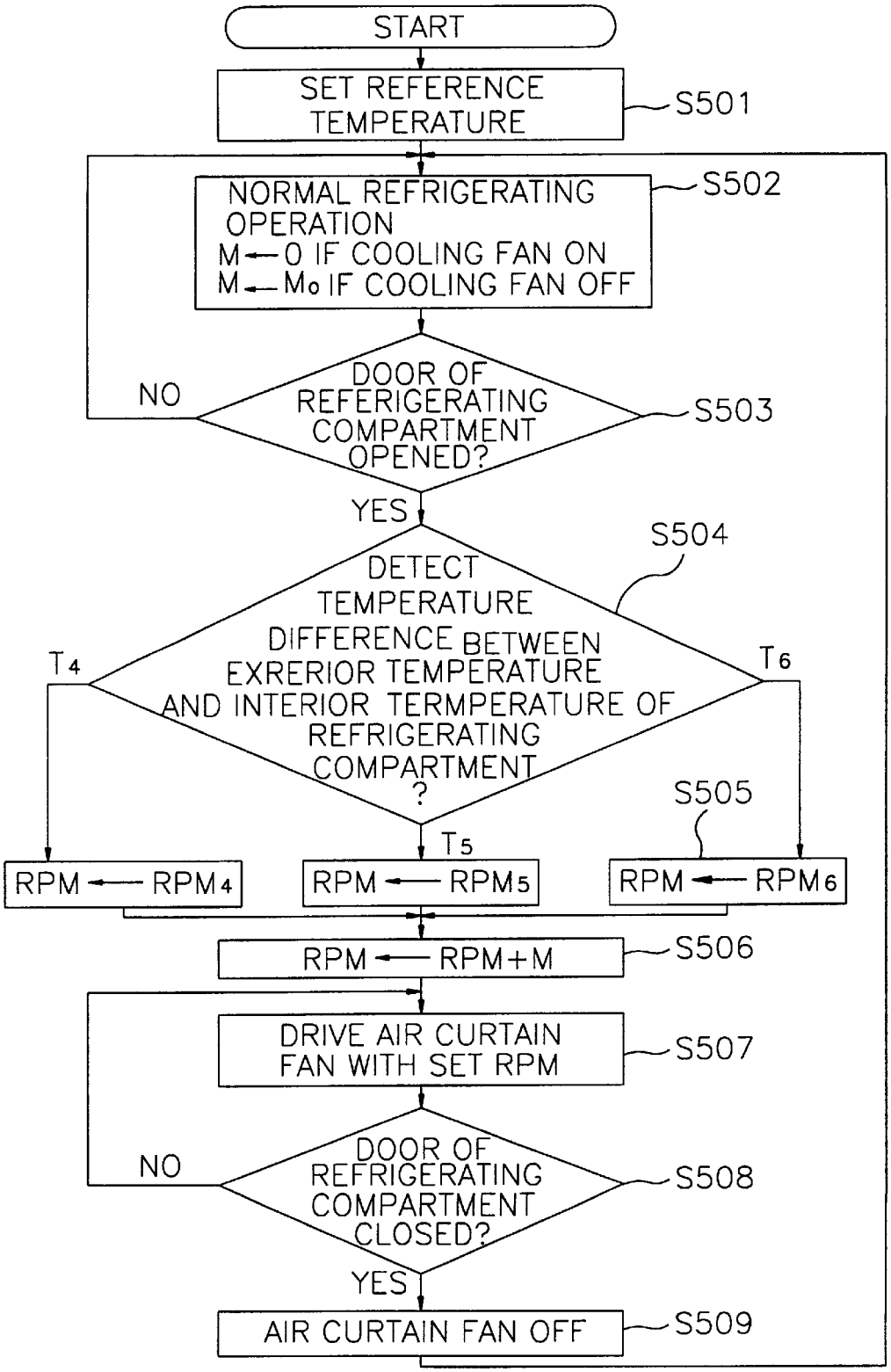
FIG. 5 is a flow chart for explaining operations of the air curtain fan driving device for a refrigerator according to the second embodiment of the present invention.

Hereinafter, the air curtain fan driving method according to the second embodiment of the present invention will be described in detail with reference to FIG. 5. FIG. 5 is a flow chart for explaining the air curtain fan driving method for a refrigerating compartment according to the second embodiment of the present invention.

If a user sets a reference temperature Tr for controlling an interior temperature T1 of the refrigerating compartment with manipulating the temperature setting part 302, the set reference temperature Tr is inputted into the control part 312 (step S501). In general, since the interior temperature T1 of the refrigerating compartment is in a range of 0° C. to 5° C., the reference temperature Tr is set from 0° C. to 5° C.

In step S502, the control part 300 enables the cooling fan 314 to be driven in case that the interior temperature T1 of the refrigerating compartment is higher than the reference temperature Tr of the refrigerating compartment, so that the normal cooling operation is performed to maintain the temperature of the refrigerating compartment at the reference temperature Tr.

While performing the normal cooling operation, the control part 300 sets the weighted value M at "0" in case that the cooling fan is disenabled, and sets the weighted value M at Mo in case that the cooling fan is enabled.

In step S503, the control part 300 detects whether the door of the refrigerating compartment is opened or closed from the door opening/closing detection part 304 during the normal cooling operation. If the door of the refrigerating compartment is closed, the refrigerator returns to the normal cooling operation (step S502). If the door of the refrigerating compartment is opened, in step (S504), the control part 300 classifies a temperature difference (T0−T1) into several temperature ranges, wherein the temperature T0 denotes the exterior temperature of the refrigerating compartment measured by means of the second temperature detecting part 308 and the temperature T1 denotes the interior temperature of the refrigerating compartment measured by means of the first temperature detecting part 306. For example, as shown in Table 2, the temperature difference (T0−T1) is classified into several temperature ranges T4(T0−T1<15° C.), T5(15° C.≦T0−T1<25° C.), and T6(25° C.≦T0−T1).

In step S505, the control part 300 sets the number of rotations RPM of the air curtain fan corresponding to each of the temperature ranges, wherein in step S505, the number of rotations is changed from RPM4 to RPM when the temperature difference (T0−T1) is included in T4, from RPM5 to RPM when the temperature difference (T0−T1) is included in T5, and from RPM6 to RPM when the temperature difference (T0−T1) is included in T6. In Table 1, the number of rotations RPM4 is set at 1500, RPM5 at 1700, and RPM6 at 1900.

In step S506, the number of rotations RPM of the air curtain fan is set with addition of the weighted value M to the number of rotations of air curtain fan preset, that is, RPM←RPM+M. In detail, if the cooling fan 314 is disenabled when the door of the refrigerating compartment is opened, the air curtain fan is enabled with the number of the rotations of the air curtain fan which is set since the weighted value M is 0(RPM←RPM+0).

In the meantime, if the cooling fan 314 is being driven when the door of the refrigerating compartment is opened, the air curtain fan is enabled with the number of rotations added by Mo to the set number of rotations of the air curtain fan since the weighted value M is Mo(RPM←RPM+Mo). From Table 2, the weighted value Mo is set at 300. In step S507, the air curtain fan 316 is driven at the number of rotations RPM.

TABLE 2

| | environment | | | | | |
|---|---|---|---|---|---|---|
| | cooling fan OFF | | | cooling fan ON | | |
| air | T4 | T5 | T6 | T4 | T5 | T6 |
| number of rotations of air curtain fan | 1500 | 1700 | 1900 | 1800 | 2000 | 2200 |

Ex) Temperature ranges of temperature difference between the exterior temperature T0 and the interior temperature T1 of the refrigerating compartment: T4/T5/T6

T4: T0−T1<20° C.

T5: 20° C.≦T0−T1<30° C.

T6: 30° C.≦T0−T1

In step S508, the control part 300 detects whether the door of the refrigerating compartment is closed.

If the door of the refrigerating compartment is opened, the air curtain fan 316 continues to be driven (step S508), but if the door of the refrigerating compartment is closed, the air curtain fan 316 turns off (step S509) so that the air curtain fan 316 starts the normal cooling operation.

As stated above, according to the second embodiment of the present invention, an exterior temperature is classified to several temperature ranges, and the air curtain fan is driven at a higher number of rotations as the exterior temperature becomes higher. Further, if the door of the refrigerating compartment is opened during the driving of the cooling fan, the cooling fan automatically stops. Accordingly, the control part 300 enables the air curtain fan to be driven with the number of rotations added by a weighted value to the normal number of rotations of the air curtain fan to compensate for the stopping of the cooling fan, so that cooling efficiency and electric power efficiency are enhanced by efficiently driving the air curtain fan according to the interior and exterior conditions of the refrigerating compartment.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as encompassing all the features of the patentable novelty that reside in the present invention, including all the features that would be treated as equivalent thereof by those skilled in the art to which this pertains.

What is claimed is:

1. An air curtain fan driving device, comprising:

a temperature setting part for setting a reference temperature of an interior of a refrigerating compartment of a refrigerator;

a door opening/closing detection part for detecting opening and closing of a door of the refrigerating compartment;

first and second temperature detecting parts for detecting the interior and exterior temperature of the refrigerating compartment, respectively;

an air curtain fan driving part for driving an air curtain fan; and a control part for 1) performing a normal cooling operation to control the interior temperature of the refrigerating compartment by driving a cooling fan when the interior temperature is above the reference temperature, 2) determining which of several temperature ranges the exterior temperature belongs in, when the opening of the door of the refrigerating compartment is detected by the door opening/closing detection part, wherein the several temperature ranges are preset, 3) driving the air curtain fan with each of a number of rotations per minute corresponding to each of the several temperature ranges according to a determination result during the opening of the door, and 4) performing the normal cooling operation by stopping the driving of the air curtain fan when the closing of the door of the refrigerating compartment is detected.

2. An air curtain fan driving device as claimed in claim 1, wherein the control part gives a weight to the number of rotations per minute if when the cooling fan is driven, and enables the air curtain fan to be driven with a weighted number of rotations per minute when the door of the refrigerating compartment is opened during the driving of the cooling fan.

3. An air curtain fan driving method, comprising the steps of:

a) performing a normal refrigerating operation for controlling an interior temperature of a refrigerating compartment by setting a reference temperature of a refrigerating compartment of a refrigerator and by driving a cooling fan when the interior temperature is above the reference temperature;

b) determining a number of rotations per minute of the air curtain fan based on an exterior temperature of the refrigerating compartment when a door of the refrigerating compartment is opened;

c) driving the air curtain fan with the number of rotations per minute by step b) while the door is opened; and d) performing the normal refrigerating operation by stopping the air curtain fan when the door of the refrigerating compartment is closed.

4. An air curtain fan driving method as claimed in claim 3, wherein the step b) includes the steps of:

b-1) determining which of temperature ranges the exterior temperature belongs in, wherein the temperature ranges are predetermined; and b-2) selecting one among numbers of rotations per minutes according to a determination result by step b-1), such that the number of rotations per minute is determined, wherein the numbers of rotations per minute are predetermined to correspond to the temperature ranges, respectively.

5. An air curtain fan driving method, comprising the steps of:

a) performing a normal refrigerating operation for controlling an interior temperature of a refrigerating compartment by setting a reference temperature of a refrigerating compartment of a refrigerator and by driving a cooling fan when the interior temperature is above a reference temperature;

b) driving the air curtain fan with a number of rotations per minute of the air curtain fan set according to several temperature ranges, wherein the several temperature ranges result from the temperature difference calculated based on the exterior temperature and the interior temperature if the opening of the door of the refrigerating compartment of the refrigerator is detected; and c) performing the normal refrigerating operation by stopping the air curtain fan if the closing of the refrigerating compartment of the refrigerator is detected.

6. An air curtain fan driving method as claimed in claim 5, wherein the temperature difference is the exterior temperature.

7. An air curtain fan driving method as claimed in claim 5, wherein the temperature difference is the difference between the exterior temperature and the interior temperature of the refrigerating compartment.

* * * * *